United States Patent [19]

Wilhelm, Jr.

[11] Patent Number: 4,753,742

[45] Date of Patent: Jun. 28, 1988

[54] LUBRICATING OILS FOR DOUGH DIVIDERS AND THE LIKE AND METHODS OF USING SAID OILS

[75] Inventor: Robert O. Wilhelm, Jr., Munhall, Pa.

[73] Assignee: Mallet & Company, Inc., Carnegie, Pa.

[21] Appl. No.: 839,872

[22] Filed: Mar. 14, 1986

[51] Int. Cl.[4] ..... C10M 137/04

[52] U.S. Cl. ..... 252/32.5; 252/49.9; 252/56 R

[58] Field of Search ..... 252/32.5, 49.9; 426/503

[56] References Cited

U.S. PATENT DOCUMENTS

| | | | |
|---|---|---|---|
| 2,002,885 | 5/1935 | Detwiler | 37/9 |
| 2,108,090 | 9/1946 | Musher | 252/49.9 |
| 2,142,998 | 1/1939 | Chittick | 37/9 |
| 2,191,996 | 2/1940 | Shoemaker et al. | 37/9 |
| 2,210,020 | 8/1940 | Hendrey | 252/49.9 |
| 2,222,487 | 11/1940 | Oosternout et al. | 252/49.9 |
| 2,244,416 | 6/1941 | Ashburn et al. | 252/49.9 |
| 2,257,601 | 9/1941 | Hall et al. | 252/49.9 |
| 2,285,854 | 6/1942 | Downing et al. | 252/49.9 |
| 2,295,172 | 9/1942 | Loane | 252/49.9 |
| 2,295,192 | 9/1942 | Arveson | 252/32.5 |
| 2,325,597 | 8/1943 | Farrington et al. | 252/32 |
| 2,370,080 | 2/1945 | Schreiber | 252/32.5 |
| 2,718,502 | 9/1955 | Francis | 252/49.9 |
| 3,108,015 | 10/1963 | Thompson | 117/134 |
| 3,467,556 | 9/1969 | Stayner | 148/25 |
| 3,489,567 | 1/1970 | McGraw | 96/85 |
| 3,518,344 | 6/1970 | Welsh et al. | 424/44 |
| 3,658,702 | 4/1972 | Forbes et al. | 252/49.9 |
| 4,062,785 | 12/1977 | Nibert | 252/49.6 |
| 4,142,003 | 2/1979 | Sejpal | 426/601 |
| 4,155,770 | 5/1979 | Doumani | 106/267 |
| 4,163,676 | 8/1979 | Konigsbacher | 106/243 |

OTHER PUBLICATIONS

Mallet & Company Product Data sheet for "Vegalube Bread Depanning Oils".

Mallet & Company Product Data Sheet for "White Mineral Oil Products for Dividers and Troughs".

*Primary Examiner*—William R. Dixon, Jr.

*Assistant Examiner*—E. McAvoy

*Attorney, Agent, or Firm*—Lynn J. Alstadt; Buchanan Ingersoll

[57] ABSTRACT

A lubricant having improved lubricating and protective properties for bread dividers and the like and methods of using the lubricants are disclosed, said lubricants are consisting essentially of 1% to 99% mineral oil suitable for food processing equipment applications and 1% to 90% lecithin, and have a minimum viscosity of 60 S.S.U. at 100° F. Other embodiments of the lubricant also contain from 1% to 20% nonionic surface active emulsifying agents. Vegetable oils may also be added to comprise from 1% to 80% of the lubricant.

6 Claims, No Drawings

LUBRICATING OILS FOR DOUGH DIVIDERS AND THE LIKE AND METHODS OF USING SAID OILS

FIELD OF THE INVENTION

The present invention relates to oil compositions useful in food processing equipment such as bread dough dividers and bun dough dividers and methods of using such oils. The oils have improved lubricating and protective properties which are useful in machinery and processing equipment to help reduce friction and minimize the wear and tear of moving parts and other components. In addition to these properties, these compositions exhibit superior releasing properties making them particularly useful for food processing machinery.

DESCRIPTION OF THE PRIOR ART

Machinery is used in the baking industry for dividing large quantities of dough into balls of appropriate size for baking into bread or rolls. These machines are commonly called bread dividers and bun dividers. Usually, the machines have pistons or hydraulic rams which compress quantities of dough in fixed chambers which define the amount of dough required for baking a particular product. Typically, in bread dividers dough is fed to a chamber, compressed in the chamber by a ram, and then cut off with a knife blade. This divided portion of dough is then released from the machine and conveyed to other areas of the bakery where it is allowed to undergo further processing, such as sheeting and proofing, and eventually goes into the baking oven. Periodic samples of the dough balls, after division, are weighed and checked against standards. It is important that the dough balls be of uniform weight. Many bakeries will not accept any dough ball which is not within one-eighth ounce of a standard weight.

Variations of weights among dough balls can be caused by such things as lack of proper lubrication, especially in the areas of the pistons, ram and knife blade, or by dough sticking to the divider or by the wear of the knife blade, ram, pistons or other components of the divider. At the present time, most bakeries use pure white mineral oils in bread divider machinery to avoid these problems These mineral oils are of varying viscosities (generally from 60–400 S.S.U. at 100° F.) and specific gravities. These oils have three principle functions. First, they furnish lubrication to the moving pistons, ram and knife blade and other components of the divider to reduce friction between these parts. Secondly, they provide a protective coating to help minimize the wearing of moving parts and other components of the divider. Thirdly, they exhibit releasing properties on the portions of the machinery which contact the dough so that the dough does not stick to the machinery. The oils also are compatible with food products.

Vegetable oils and vegetable oil compositions have also been proposed for use in bread dividers. These oils have been used to a very limited extent. However, vegetable oils, such as soybean oil, have a tendency to polymerize when exposed on a limited surface for extended periods of time in the atmosphere and when subjected to harsh conditions. This phenomenon can occur when vegetable oils, such as soybean oil, are used alone or in combination with mineral oil depending on the amount of vegetable oil present and the conditions under which the oil is used. For that reason, some divider manufacturers instruct customers not to use a vegetable base oil in their present dividers and will not warranty their equipment if, in fact, vegetable oils are used. Other kinds of oils are not used in bread dividers primarily because such other oils are not compatible with food products.

Much effort has been made to develop oils which can be used as release agents in the baking industry as well as for other food processing areas. These oils are used to prevent food from sticking to pans and other cooking utensils and have been commonly termed "release agents" or "lubricants" in baking and cooking. Mineral based oil combinations have been developed for use in the food industry as release agents. Doumani in U.S. Pat. No. 4,155,770 discloses one type of mineral oil modified lecithin release agent comprising lecithin in an essentially anhydrous vehicle of white mineral oil, vegetable oil and ethanol or isopropanol in proportions providing a Saybolt viscosity at 100° F. of less than 165 S.S.U. Doumani is principally concerned with an oil that can be dispensed through a spray pump and provide desirable release properties for the release of food from cooking surfaces of pans and other cooking utensils. His oil is not intended for use as a lubricating oil for machinery or other processing equipment to reduce friction and minimize wear of moving parts and other components.

As Doumani described in his patent, there have been numerous uses of lecithin in combination with mineral oil and vegetable oil as a release agent for cookware of all kinds. These release agents, as mentioned previously, are also sometimes commonly termed lubricants in baking and cooking. Lubrication, in these terms, refers to the coating of pans and other cooking surfaces with compositions which will permit foods to be released from these surfaces without sticking. Whereas lubrication, with reference to equipment, such as bread dough dividers or even automobiles, refers to the treating of moving parts with substances which reduce friction between these parts and other components of the equipment as well as help minimize the wearing of these parts during the actual operation of the equipment.

Typically, lecithin is diluted with vegetable oils and/or vegetable oil and mineral oil blends when used as a release agent for cookware. Frequently and especially in direct consumer applications, other materials such as freon, ethanol or isopropye alcohol are added to improve flow characteristics essential for spray applications or other usages to effectively provide a thin layer when applied to pans and other cooking surfaces. These additional elements cause the releasable oils to generally be more expensive than either the vegetable oil and/or the vegetable oil and pure white mineral oil blends. Despite the wide availability of these release agents to the baking industry, the industry has not used these products in bread dividers as lubricating oils. I am not aware of any study or report which mentions or suggests that release agents can be used for lubricating moving parts or will reduce friction between moving parts. Several factors may be responsible for this. First, these release agents were not designed or intended to be used as lubricating oils in processing equipment for the reduction of friction and the minimization of wear of moving parts and other components. They were designed for cooking or baking surfaces to facilitate the releasing of food from these surfaces. Secondly, most of the releasing oils contain high quantities of vegetable oils, such as soybean oil, which may polymerize in some divider equipment which is not only undesirable, but may cause damage to the equipment. Thirdly, the additional compounds such as alcohol and freon provide no benefit in an oil used for bread dividers and, in fact, would make some of these release agents totally unsuitable for some divider applications. Finally, mineral oil performs acceptably in this equipment and there is a reluctance in the baking industry to depart from a product which works well. These same factors also explain the fact that these release agents are not used in other processing equipment as lubricating oils.

SUMMARY OF THE INVENTION

I have found that the addition of lecithin to mineral oil in a composition containing from 1% to 90% lecithin and the balance mineral oil provides improved lubricating and protective properties over the pure white mineral oil itself. This is particularly true when the viscosity of the composition is a minimum of 60 S.S.U. at 100° F. Repeated tests have shown that the addition of from 1% to 90% lecithin to mineral oil significantly reduces the measured wear scar diameter in the "four ball wear test" (ASTM D-2276). In addition, in tests with processing equipment, notably bread dividers, these compositions have shown marked improvement in lubricating and protective properties over pure white mineral oil. In these tests, improvement in lubricating characteristics was noted by the monitoring of the effects of the composition on the amount of energy required to operate the divider as well as by the comparison of actual scaling weights obtained with the composition versus those found with the pure white mineral oil itself. The amount of such energy required for operation of the divider was substantially reduced and the actual weights of dough samples taken during the tests were found to exhibit much better scaling consistency over weights of dough samples processed with pure white mineral oil. This indicates a reduction in friction and wear between moving parts and other components in the divider which should extend the life of these parts.

I have also found that the level of lecithin in these compositions necessary to show improved lubricating and protective properties over the pure white mineral oil base itself will be determined by several factors. First, the initial viscosity and type of mineral oil used. In general, I have found that the lower the viscosity of the mineral oil, the higher the level of lecithin required to produce significant improvements as noted by the results of the four ball wear tests. A second factor is the ultimate viscosity of the composition required. Some particular machinery applications dictate rigid viscosity standards to maintain peak operational efficiency. For example, in some dividers such as Model K bun divider, oils of approximately 200 S.S.U. at 100° F. have been found to provide the most effectiveness. In bread dividers, compositions of 100 S.S.U. at 100° F. or lower appear to have the most widespread use in the industry. In addition, the age of the equipment will also have a bearing on the optimum composition viscosity required. In general, the older and more worn the equipment, the greater tolerance between moving parts, and, hence, the higher composition viscosity required for optimum performance. Another factor is the type of application conditions to which the composition will be subjected. Examples of these conditions would be high heat exposure, low temperature exposure, type of food exposure, high humidity exposure as well as numerous other factors. The correlation between these factors, viscosity and lubricant performance is known to those skilled in the art and need not be discussed here.

There are also other determining aspects which are known to those skilled in the art and not discussed in detail here and which could have an effect regarding the choice of the optimum oil composition for a given machinery application. There are, for example, applications where a composition with a viscosity of approximately 210 S.S.U at 100° F. is required. Several compositions of that viscosity containing different ratios of mineral oil and lecithin can be constructed. Each composition will have its own separate properties, but not all will be suitable for the application and be more effective than pure white mineral oil itself with the same viscosity of 210 S.S.U. at 100° F. For example, one particular composition could be composed of 99% pure white mineral oil with a viscosity of approximately 205 S.S.U. at 100° F. and the addition of 1% lecithin to achieve a finished composition viscosity of approximately 210 S.S.U. at 100° F. This composition can also be constructed by using a pure white mineral oil with a viscosity of 90 S.S.U. at 100° F. at a 50% level in combination with 50% lecithin. Both of these compositions will have the same viscosity, but each will exhibit significantly different physical properties which are extremely important with regard to various applications. Again, both of these compositions will have superior lubricating and protective properties over the pure white mineral oil itself.

Nevertheless, I have found that these different physical properties can make one composition be more effective in a given application than other mineral oil-lecithin mixtures. For example, in the Model K bun divider, too high a quantity of lecithin could create problems in the vacuum systems where oil is drawn to the compressor. The high heat exposure could cause the 50% lecithin composition to "breakdown" which will destroy the composition's ability to lubricate as well as even damage the equipment itself, obviously making it less effective than even the pure white mineral oil itself with the same viscosity of 210 S.S.U. at 100° F. This is a fact regardless of the superior lubricating characteristics of the composition relative to the pure white mineral oil, as other properties regarding thermal and oxidative instability of the composition precluded its superiority with regard to lubrication characteristics and making it unsuitable for this application. On the other hand, a composition containing 1% lecithin will provide significantly improved results without causing problems in the vacuum system. If these same compositions were used in bread dividers, and are not exposed to high heat in the divider, the composition containing 50% lecithin may provide the most effective results.

I have also found that compositions with as little as 1% lecithin can improve the lubricating and protective characteristics over a pure white mineral oil base as shown in the test results in Table I. Further, I have determined that there is an upper limit of 90% lecithin in some compositions. If one exceeds that limit the viscosity of the composition will be too high for most applications. It should be understood that this limit is a result of the high finished composition viscosity, rather than a limitation of lubricating or protective characteristics of the composition.

In addition to lecithin, I have found that other surface active agents, such as some nonionic emulsifiers, when incorporated into these compositions at levels from as low as 1% showed some benefit. Levels of use up to 20% in compositions were also found to be effective. These compositions must also have a minumum viscosity of 60 S.S.U. at 100° F. But, use of these materials increases the relative cost of the composition making a cost/performance situation of diminishing returns at this time. That is, any improvements in lubricity were minimal relative to the cost increase.

Another method of constructing my compositions is the addition of some quantity of vegetable oil in varying amounts again depending upon the equipment application. It should be understood that unless otherwise indicated the term vegetable oil as used herein shall encompass both a single vegetable oil and a combination of two or more different vegetable oils. "Stabilized" vegetable oils, such as soybean oil with a suitable level of the antioxidants, such as TBHQ, to help protect against oxidation, or the use of partially hydrogenated vegetable oil with and without stabilization have provided significant results. Levels of from 10–80% vegetable oil have shown notable improvements in some applications.

All of these compositions have improved lubricating and protective characteristics relative to the pure white mineral oil base itself and will be particularly useful in processing equipment.

The lecithin used in my tests was a commercial grade fluid lecithin with the following specifications:

| | |
|---|---|
| Acetone Insolubles | 60–65% |
| Acid Value | 25–30 |

Here, most available commercial grade lecithins will suffice. In addition, the pure white mineral oils used were food grade mineral oils with a minimum viscosity of 65 S.S.U. at 100° F. Further, these mineral oils were either N.F. or U.S.P. grade. Again, other mineral oils, depending on the usage and application, will suffice.

DESCRIPTION OF THE PREFERRED EMBODIMENTS

I created eleven different lubricants and tested them using the four ball wear test. I also conducted tests using some of these lubricants in bread dividers. The formulation and viscosities at 100° F. for each of the examples used in my tests are as follows:

| | |
|---|---|
| EXAMPLE I (Viscosity 90 S.S.U. at 100° F.) | |
| mineral oil (viscosity 89 S.S.U. at 100° F.) | 99% |
| lecithin | 1% |
| EXAMPLE II (Viscosity 99 S.S.U. at 100° F.) | |
| mineral oil (viscosity 89 S.S.U. at 100° F.) | 90% |
| lecithin | 10% |
| EXAMPLE III (Viscosity 125 S.S.U. at 100° F.) | |
| mineral oil (viscosity 89 S.S.U. at 100° F.) | 75% |
| lecithin | 25% |
| EXAMPLE IV (Viscosity 233 S.S.U. at 100° F.) | |
| mineral oil (viscosity 89 S.S.U. at 100° F.) | 50% |
| lecithin | 50% |
| EXAMPLE V (Viscosity 807 S.S.U. at 100° F.) | |
| mineral oil (viscosity 89 S.S.U. at 100° F.) | 25% |
| lecithin | 75% |
| EXAMPLE VI (Viscosity 78 S.S.U. at 100° F.) | |

-continued

| | |
|---|---|
| mineral oil (viscosity 71 S.S.U. at 100° F.) | 90% |
| lecithin | 10% |
| EXAMPLE VII (Viscosity 108 S.S.U. at 100° F.) | |
| mineral oil (viscosity 71 S.S.U. at 100° F.) | 70% |
| lecithin | 30% |
| EXAMPLE VIII (Viscosity 397 S.S.U. at 100° F.) | |
| mineral oil (viscosity 212 S.S.U. at 100° F.) | 50% |
| lecithin | 50% |
| EXAMPLE IX (Viscosity 144 S.S.U. at 100° F.) | |
| mineral oil (viscosity 89 S.S.U. at 100° F.) | 70% |
| lecithin | 25% |
| glyceryl mono oleate | 5% |
| EXAMPLE X (Viscosity 250 S.S.U. at 100° F.) | |
| mineral oil (viscosity 89 S.S.U. at 100° F.) | 8% |
| lecithin | 25% |
| vegetable oil (partially hydrogenated soybean oil) | 67% |
| EXAMPLE XI (Viscosity 105 S.S.U. at 100° F.) | |
| mineral oil (viscosity 71 S.S.U. at 100° F.) | 50% |
| lecithin | 5% |
| vegetable oil (soybean oil) | 45% |

These formulations and four mineral oils were tested using the four ball wear tests set forth in ASTM D-2276. The results of these tests are shown in Table I. The standard temperature for this test is 167° F. However, because the oil is not normally used above 100° F. in most bread dividers, tests were started at 100° F. as an additional measurement. For that reason, data was taken using both the standard temperature range and the lower initial temperature.

TABLE I

RESULTS OF FOUR BALL WEAR TESTS

| SAMPLE | VISCOSITY 100° F. | WEAR SCAR DIAMETER AT 100° F. (initial) | 167° F. |
|---|---|---|---|
| Mineral Oil (Drakeol 7) | 71 S.S.U. | 1.500 | 0.700 |
| Mineral Oil (Drakeol 9) | 89 S.S.U. | 1.340 | 1.380 |
| Mineral Oil (Drakeol 10) | 102 S.S.U. | 0.917 | 0.679 |
| Mineral Oil (Drakeol 21) | 212 S.S.U. | 1.520 | 1.460 |
| I | 90 S.S.U. | 0.540 | 0.580 |
| II | 99 S.S.U. | 0.560 | 0.540 |
| III | 125 S.S.U. | 0.590 | 0.580 |
| IV | 233 S.S.U. | 0.560 | 0.580 |
| V | 807 S.S.U. | 0.370 | 0.660 |
| VI | 78 S.S.U. | 0.733 | 0.700 |
| VII | 108 S.S.U. | 0.500 | 0.450 |
| VIII | 397 S.S.U. | 0.390 | 0.580 |
| IX | 144 S.S.U. | 0.550 | 0.620 |
| X | 250 S.S.U. | 0.450 | 0.570 |
| XI | 105 S.S.U. | 0.520 | 0.520 |

These tests indicate that the lubricants containing lecithin, Examples I thru XI, performed substantially better than those not containing lecithin under almost all conditions. At 100° F., some of my lubricants showed improvements of from two to three times. Also, I observed a relationship between the performance of the lubricant in the wear test and its viscosity. I found that, in general, the higher the viscosity of the lubricant, the better the performance given the same relative composition and mineral oil base.

To further confirm that my lubricants work better I tested some of these formulations in bread dividers. These tests revealed that when my compositions were used less energy was required to operate the divider and better scaling weight consistency was noted over pure mineral oil.

I have further learned that the addition of other surface active agents such as nonionic emulsifiers to the lubricant containing mineral oil and lecithin can further improve the lubricity of this lubricant. Examples of such nonionic emulsifiers include mono and diglycerides, polysorbates and polyglycerol esters. One of these compositions which I compounded containing nonionic emulsifiers is covered in Example IX and was also tested. The results of that test are also shown in Table I.

Although I have described my lubricants in use on bread dividers and bun dividers, these lubricants should provide improved lubricity and release characteristics in all food processing equipment in which food products come into contact with moving parts of the equipment. In such equipment my lubricants should be applied to at least one of the moving parts.

While I have shown and described a present preferred embodiment of the invention, it is to be distinctly understood that the invention is not limited thereto but may be otherwise variously embodied within the scope of the following claims.

I claim:

1. A lubricant composition having improved lubricity and protective properties for dough dividers and other processing equipment in which oil is applied to moving parts some of which come into contact with food products consisting essentially of 10% to 99% mineral oil suitable for food processing equipment applications and 1% to 90% lecithin such composition having a minimum viscosity of 60 S.S.U. at 100° F.

2. A lubricant composition having improved lubricity and protective properties for dough dividers and other processing equipment in which oil is applied to moving parts some of which come into contact with food products consisting essentially of from 1% to 98% mineral oil suitable for food processing equipment applications, from 1% to 90% lecithin and from 1% to 20% nonionic surface active emuslifying agents such composition having a minimum viscosity of 60 S.S.U. at 100° F.

3. The lubricant of claim 2 wherein the nonionic surface active emulsifying agents are selected from the group comprised of mono and diglycerides, polysorbates and polyglycerol esters.

4. A composition having improved lubricity and protective properties for dough dividers and other processing equipment in which oil is applied to moving parts some of which come into contact with food products consisting essentially of from 1% to 98% mineral oil suitable for food processing equipment applications, from 1% to 90% lecithin and from 1% to 50% vegetable oil such composition having a minimum viscosity of 60 S.S.U. at 100° F.

5. The lubricant of claim 4 wherein the vegetable oil is a stabilized vegetable oil.

6. The lubricant of claim 4 wherein the vegetable oil is partially hydrogenated.

* * * * *

UNITED STATES PATENT AND TRADEMARK OFFICE

CERTIFICATE OF CORRECTION

PATENT NO. : 4,753,742

DATED : June 28, 1988

INVENTOR(S) : ROBERT O. WILHELM, JR.

It is certified that error appears in the above-identified patent and that said Letters Patent is hereby corrected as shown below:

At [56], References Cited, change "2,108,090" to --2,408,090-- change "2,210,020" to --2,212,020--.

Column 1, line 45, after "problems" insert --.--.

Column 2, line 48, change "isopropye" to -- isopropyl --.

Signed and Sealed this

Third Day of January, 1989

*Attest:*

DONALD J. QUIGG

*Attesting Officer*

*Commissioner of Patents and Trademarks*